United States Patent [19]

Becker

[11] 3,995,340

[45] Dec. 7, 1976

[54] SHOE LASTING MACHINES

[75] Inventor: Karl V. Becker, Boxford, Mass.

[73] Assignee: USM Corporation, Boston, Mass.

[22] Filed: May 8, 1975

[21] Appl. No.: 575,836

[52] U.S. Cl. ..... 12/8.1; 12/10.1

[51] Int. Cl.[2] ..... A43D 21/12

[58] Field of Search ..... 12/8.1, 10, 10.1, 8.2, 12/7, 12, 14.5

[56] References Cited

UNITED STATES PATENTS

| | | | |
|---|---|---|---|
| 2,655,672 | 10/1953 | Courchene | 12/8.1 |
| 3,205,516 | 9/1965 | Wilisch | 12/8.1 |
| 3,264,666 | 8/1966 | Akerley | 12/12 |
| 3,561,028 | 2/1972 | Bowler | 12/12 |
| 3,562,828 | 2/1971 | Gowler et al. | 12/14.5 |

*Primary Examiner*—Patrick D. Lawson

*Attorney, Agent, or Firm*—Donald N. Halgren; Richard B. Megley; Vincent A. White

[57] ABSTRACT

A machine for lasting a shoe wherein specially contoured resilient side wipers coact with extensible heel seat wipers to last the sides and heel end simultaneously. Each side wiper is complementarily shaped to the respective contours of the shoe bottom and featherline. An arrangement of pincers pull the upper margin over a precemented insole, then the contoured side wipers floatingly locate and inwardly force the upper margin to the insole, and the extensible heel wipers last the upper margin of the heel, providing a continuity of wiping from the heel to the breastline of the shoe.

13 Claims, 13 Drawing Figures

SHOE LASTING MACHINES

BACKGROUND OF THE INVENTION

1. Field of the Invention

This invention relates generally to the lasting of shoes and more particularly to providing continuity in wiping a shoe upper along its side and heel and improved side wiping therewith.

2. Description of the Prior Art

Previous approaches to lasting shoe uppers have included machines with lasting rolls, or machines with articulating fingers. One such machine for lasting a shoe in that shown in U.S. Pat. No. 3,264,666 wherein a resilient band engages the upper and shoe bottom margin and wraps a portion of the upper heightwise over the margin of the last bottom. Another machine for lasting a shoe is shown in U. S. Pat. No. 3,561,028 wherein a plurality of wipers are adjustably secured together to form a variably curved surface permitting conformance generally to a section of the heightwise curvature of the last bottom. Still other U.S. Pats. such as Nos. 3,562,828 and 3,727,257 disclose machines for automatically gripping the shoe uppers and tensioning them about the insoles. None of the above cited patents directs itself to providing a continuity of said and heel wiping in a single operation while yielding a quality shoe.

It has been found desirable, therefore, to improve shoe lasting by providing a machine which may wipe the upper margin with wipers that are in general conformity to the contours of the shoe bottom and sides of the shoe being assembled and to simultaneously wipe the heel end wherein continuity is provided by the wiping mechanisms around the margin of the shoe from one side of the ball zone around the heel to the other side of the ball zone. These are improvements over the prior art to which the present invention is directed.

SUMMARY OF THE INVENTION

According to the present invention, the machine is provided with a pair of shoe lasting instrumentalities, one pair each for a left and a right shoe, one being a mirror image of the other. Each lasting instrumentality comprises a maneuverable shoe last support arrangement, a telescoping heel wiper, a pair of shank locating contoured resilient side wipers, cross-drafting pincers, and a toe support. The shoe last has an upper and an insole assembled thereon, with the toe portion of the upper pull-lasted in a prior operation, and with cement applied to the insole margin by an arrangement of nozzles which may comprise a portion of the present machine. The inverted shoe last is placed on the shoe support, the toe is clamped, the side wipers and pincers are positioned, and the grippers tension the margin of the upper about the insole. The side wipers are pressed against the featherline and the heel end is clamped, the grippers release the tensioned upper, and the side and heel portions are wiped and bedding pressure applied. The side wipers are contoured to complement the featherline and shoe bottom during the wiping and bedding action. Because of the contour to the side wippers and their hinged support arrangement, they can engage the side of the shoe and floatingly locate the ball zone on the shoe bottom and wipe widthwise and heelwise to permit proper distribution of the upper material and effective adhesion of the upper margin to the shoe bottom. The mating of the respective contoured wipers with the complementary left or right side of the shoe and the telescoping arms of the heel wiper, which extend as far as the heelward end of each respective side wiper, provide a continuity of wiping simultaneously at each side of the shoe from the ball line around the entire heel end.

BRIEF DESCRIPTION OF THE DRAWINGS

The objects and advantages of the invention will become more apparent when viewed in conjunction with the following drawings, in which.

DESCRIPTION OF THE PREFERRED EMBODIMENT

Figure 1:
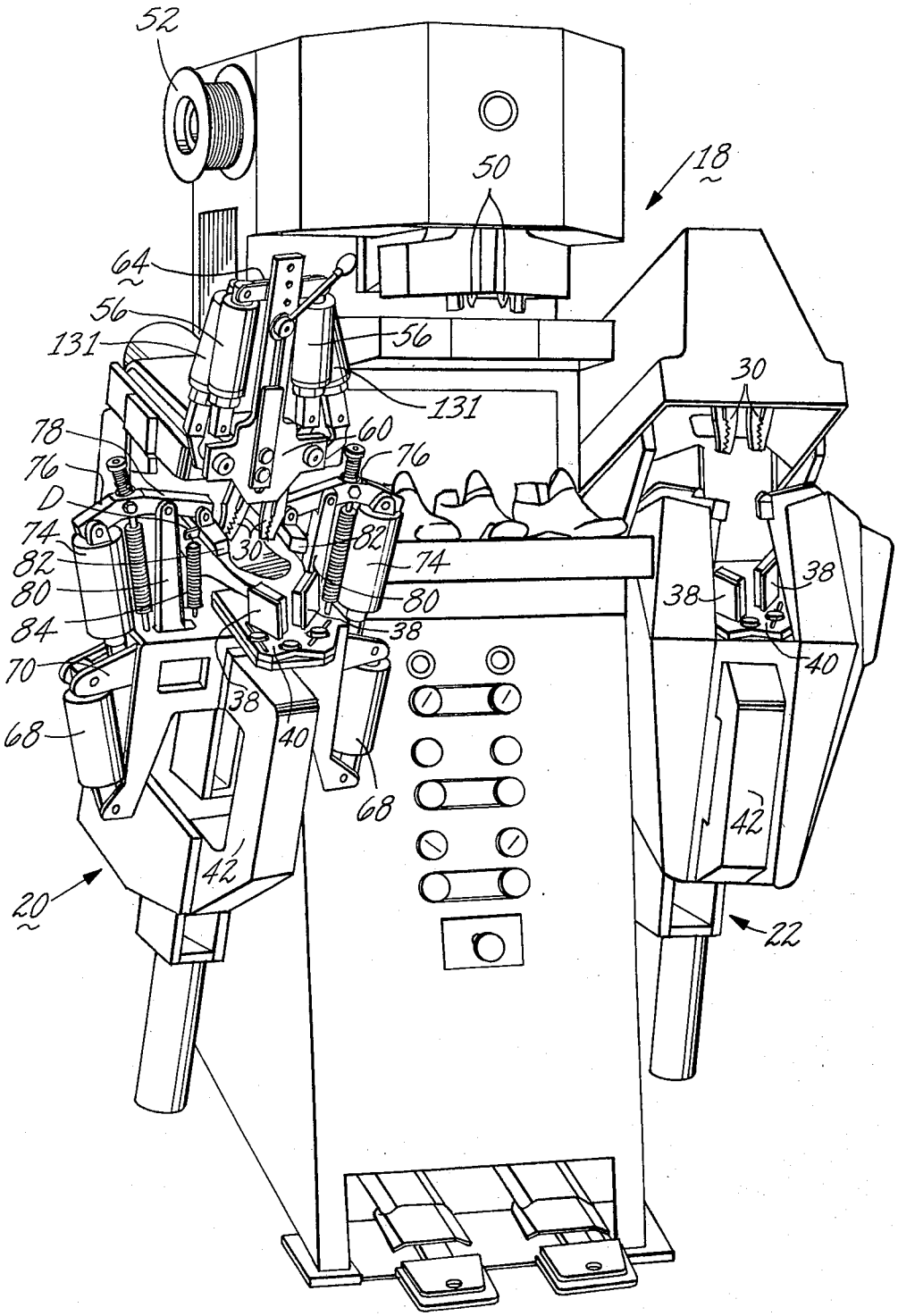
FIG. 1 is a perspective view of a shoe lasting machine constructed according to the principles of the present invention.

The illustrative machine, including the preferred embodiment of the invention, as generally shown in FIG. 1, is a shoe upper conforming machine 18 suitable for use in both pulling and lasting a shoe upper in the ball, shank and heel portions of a previously toe lasted shoe, The machine 18 may include both one of a left shoe and one of a right shoe lasting instrumentality, 20 and 22. Each lasting instrumentality 20 and 22 is comprised of an arrangement of side wipers, a toe positioning support, a heel band and an upper tensioning apparatus, each arranged to accommodate the particularities of a left shoe or a right shoe, the details of which will be described further. A typical lasting instrumentality, 20 and 22, is shown more clearly in FIGS. 2, 3, 4 and 5. It includes a heel seat lasting and backpart molding station comprising a shoe support provided by a jack post 24 having a last pin 26 on which there is placed a shoe last 27 with an upper and an insole assembled thereon. The last post is slidable heightwise and is yieldably carried on a piston rod, not shown.

Figure 5:
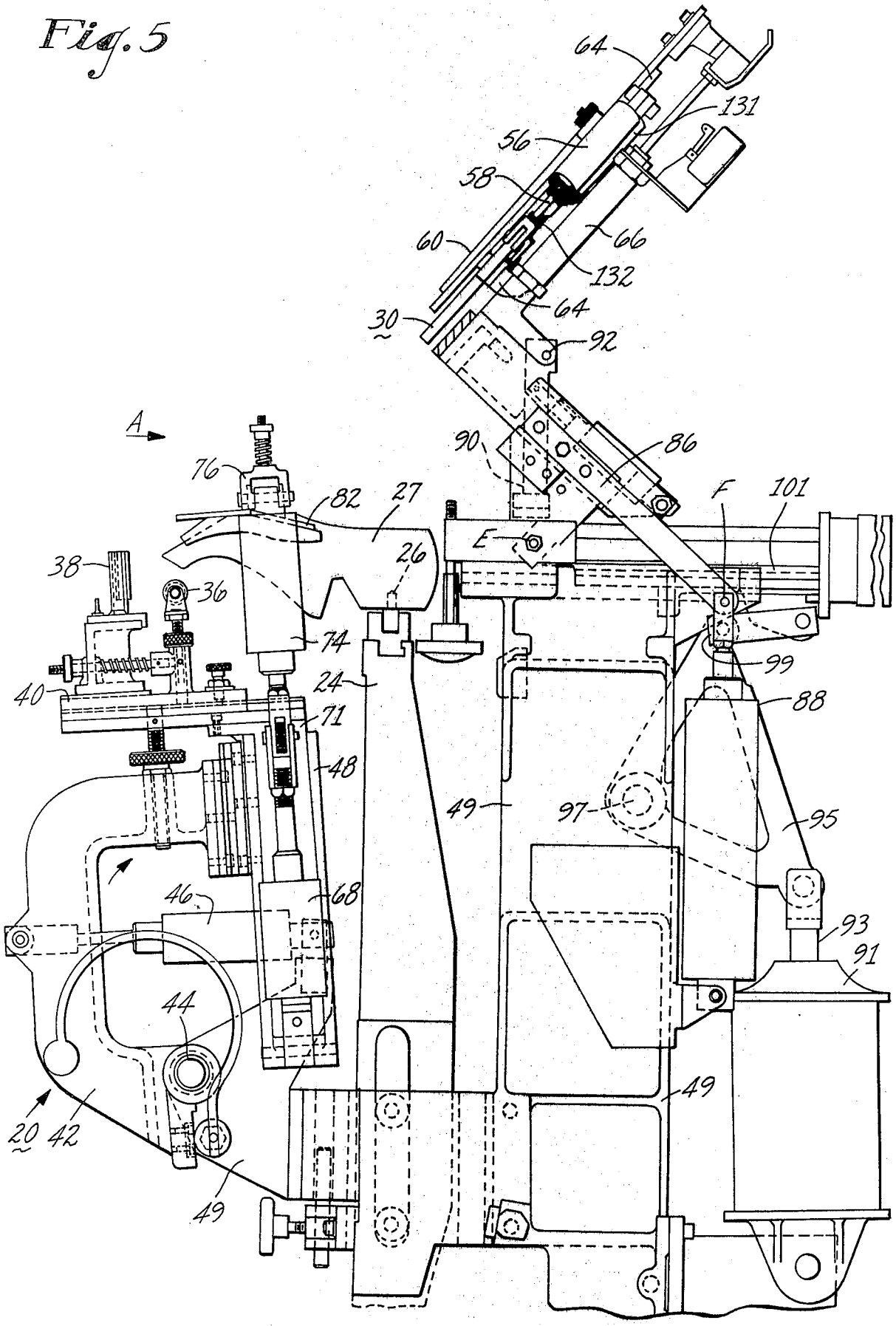
FIG. 5 is a side elevational view of the lasting instrumentality illustrated in FIG. 4 but shown in its last mounting, precycle mode.

The shoe last 27 is inverted, so that the bottom is facing upwardly, with the heel of the last 27 directed toward the body of the machine, which is toward the right in FIG. 5. The last pin 26 engages a thimble, not shown, in the last 27 and therewith supports the same. An adjustable toe support 36 receives the upper, and a pair of adjustable toe pads 38 mounted on a longitudinally movable carriage 40 engages the toe end of the shoe and positions the same.

Figure 10:
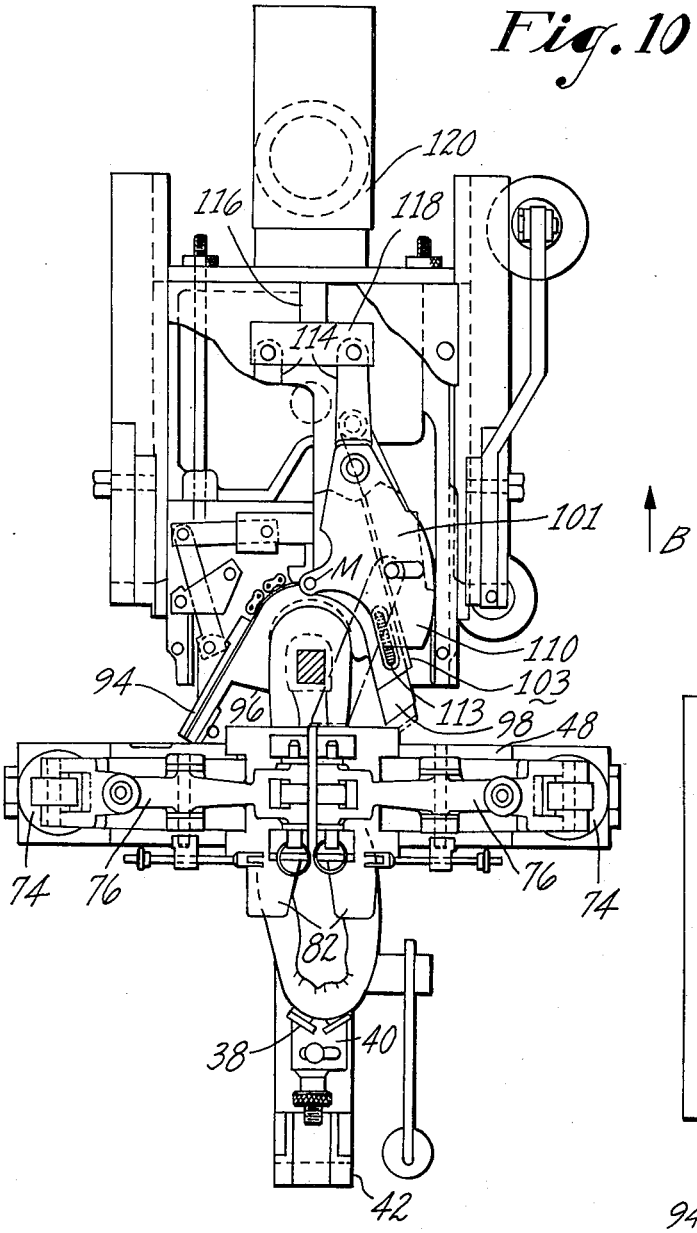
FIG. 10 and 11 are plan views showing progressive states of the heel and side wiping modes of the invention.
Figure 11:
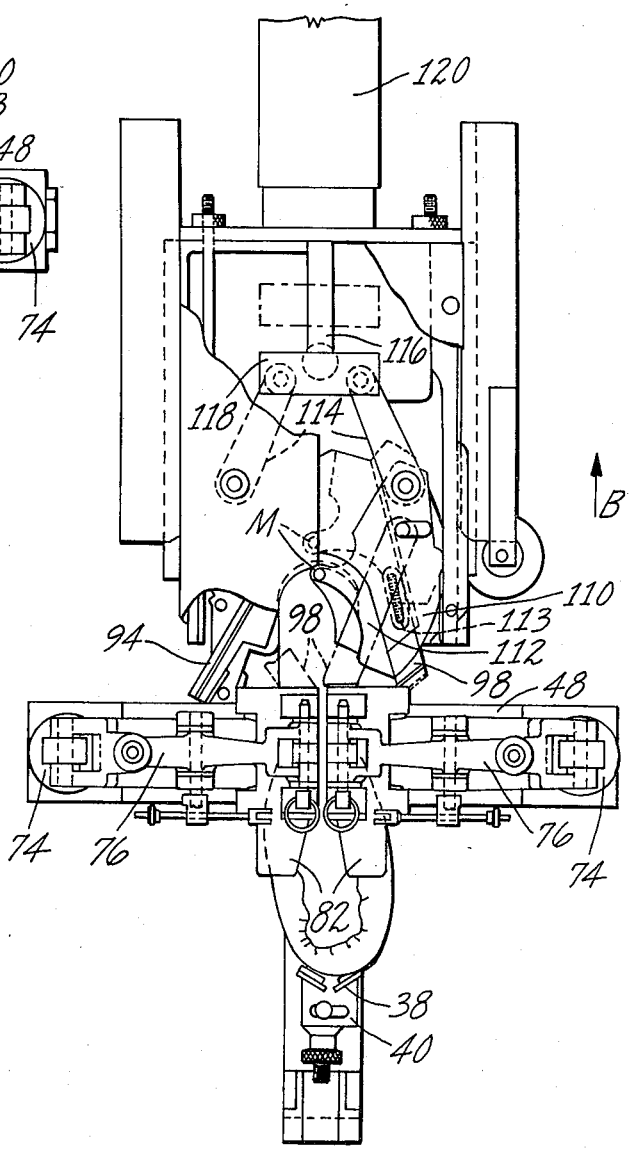

The term "longitudinally" shall mean along the long axis of the shoe and is exemplified by a generally left and right direction when viewing FIGS. 5 through 8. The term "rearwardly" is synonymous with "heelwardly" and is meant to define a direction indicated by the arrow A, as shown in FIG. 5 or by the arrow B as shown in FIGS. 10 and 11.

The toe support 36, and toe pads 38 with their respective carriage 40, are disposed on an arcuately swinging yoke 42 which pivots about a lower transverse axis 44. The yoke 42 moved by a cylinder arrangement 46 hinged at one end to the yoke 42 and at the other end to a portion of a frame base 49 of its respective lasting instrumentality 20 or 22.

Each shoe before being mounted on the jack post 24 has adhesive applied thereto by a pair of nozzles 50 movably mounted generally centrally between each of the two lasting instrumentalities 20 and 22, as shown in FIG. 1. The nozzles 50 are adapted to extrude adhesive on the margin of the insole against which the margin of the upper will be wiped and secured. The adhesive may be originally in solid form and wound on spools 52, such as shown in FIG. 1, and then be melted and extruded onto the insole margin. Other types of adhesive may be applied by a variety of means without departing from the scope of the invention.

Figure 2:
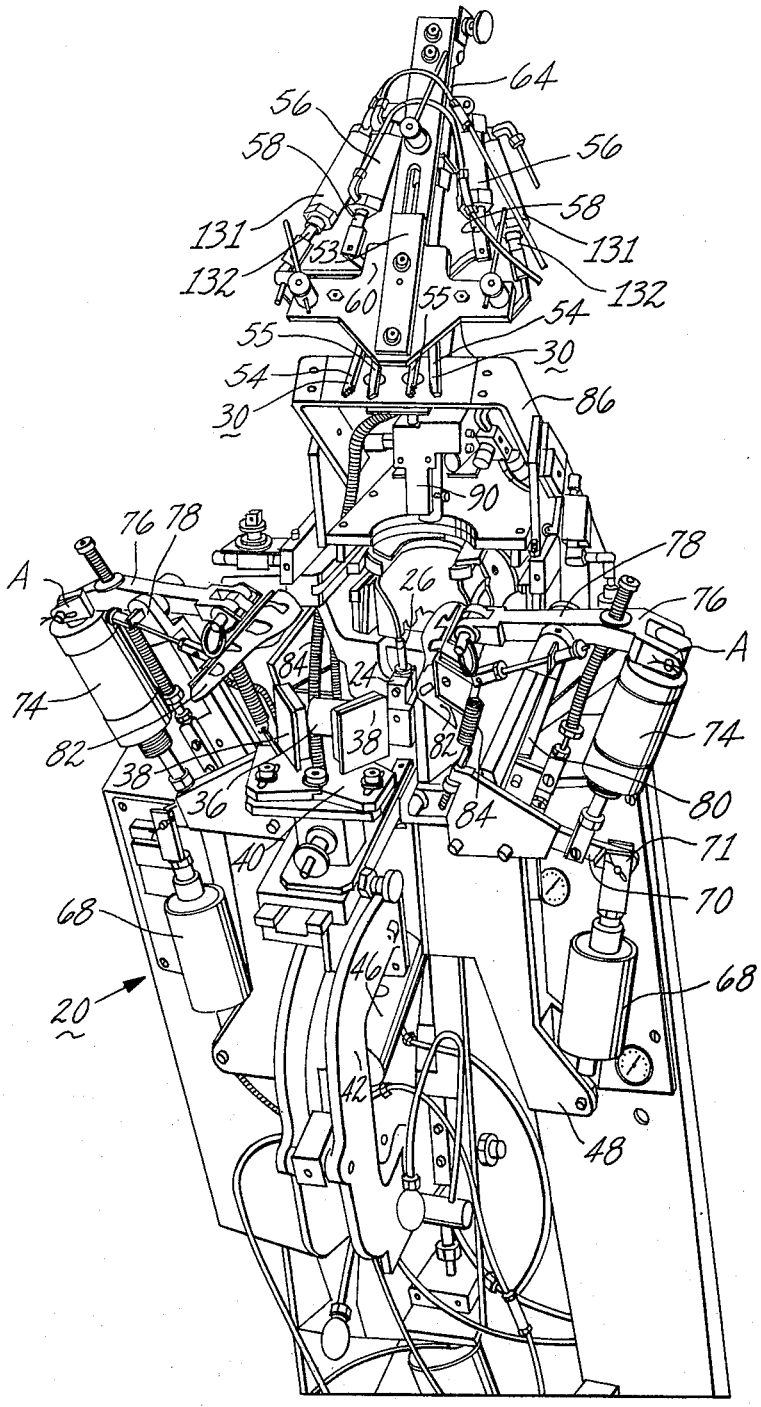
FIG. 2 is a perspective view of one of the lasting instrumentalities of the present invention in its precycle position.
Figure 9:
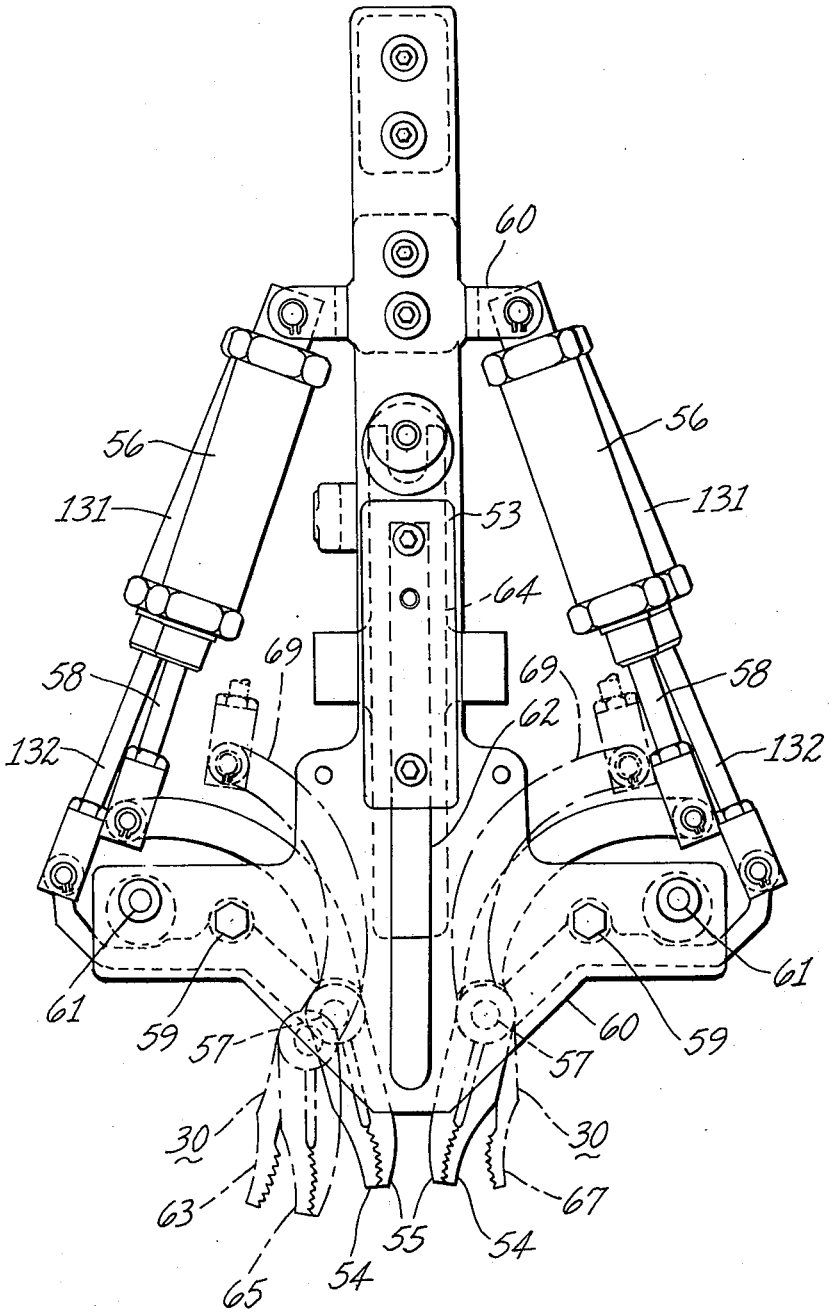
FIG. 9 is a front elevational view of the machine upper tensioning arrangement.

The shoe, being previously toe lasted, and having received an amount of adhesive around the remainder of the periphery or margin of the insole, is placed bottom side up on the jack post 24. One of the lasting instrumentalities 20 is shown in FIG. 2 in its shoe receiving mode. This mode is also shown on a partial side elevation in FIG. 5. The toe pads 38, and the toe support 36, have not yet been caused to move to their shoe engaging position. FIGS. 2 and 5 show the pincers or gripper members 30 in their open position. Each gripper 30 comprises a pair of movable jaw members 54 and 55 which will open and close in response to the action of a pair of cylinders 56 and 131, the top of each being attached to a pair of lugs extending from a movable carriage 60. Each of the jaws 54 and 55 is formed on the lower ends of arcuately shaped members pivotally attached at their uppermost ends to piston rods 58 and 132 of the cylinders 56 and 131. The grippers are pivotally mounted on the carriage 60. The carriage 60 slides on the frame 64 having a slot 62 and folower 53 arrangement therebetween. A side view of the gripper arrangement is shown in FIGS. 5, 6, 7 and 8 and a front view is shown in FIG. 9. The carriage 60 is movably guided along the slot 62 by yet another cylinder arrangement 66 shown in FIGS. 5 and 6. The movability of the carriage 60 permits a height adjustment for the grippers 30. The upper end of cylinder 66 is attached to the carriage 60, the lower end of cylinder 66 is attached to a frame 86 which will be described in more detail below. Pressurization and de-pressurization of cylinder 66 causes the raising and lowering of carriage 60 respectively. The carriage 60 is slidably attached to frame 64 and rises and falls therewith. The carriage 60 also moves with regard to frame 64 when the cylinders 56 are pressurized or depressurized, which also move the grippers 30.

The movable jaws 54 and 55 each move with respect to one another about a hinge point 57. Each innermost jaw 55 is pivotally attached to the frame 60 and pivots about an axis 59, which is stationary with respect to frame 60. A cam member 61 is rotatably mounted in the frame 60 and engages the leg of jaw 55. By rotatably adjusting the cam member 61, the opening between the jaws 54 and 55 can be adjusted. An array of phantom lines indicated by the numerals 63, 65, 67 and 69, shown in FIG. 9, give the example of positions of portions of the jaw members 54 and 55 at several locations in its cycle. The pressurizable cylinder 131 maintains an outwardly directed force upon each jaw 55 while regulation of pressure within each cylinder 56 and movement of frame 60 cause the grippers 30 to hold and pull the margin of the upper.

Figure 3:
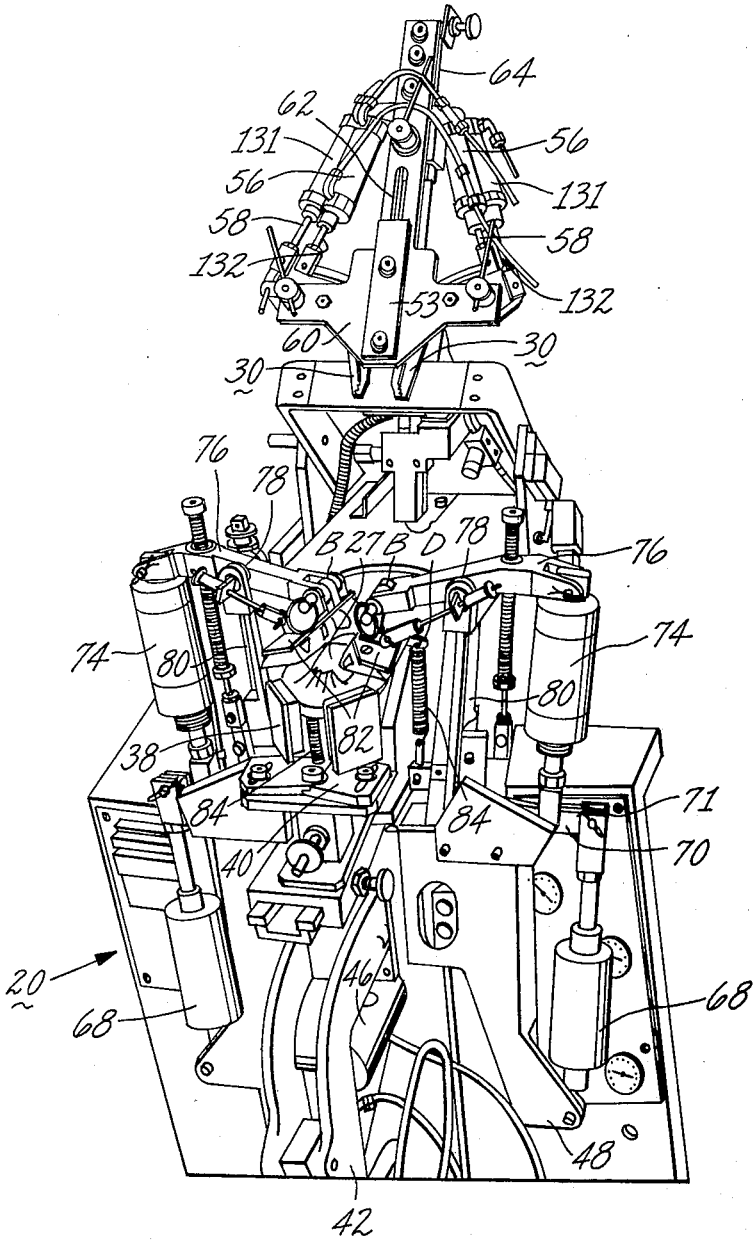
FIG. 3 is another perspective view of one of the lasting instrumentalities of the present invention in its bedding position.
Figure 4:
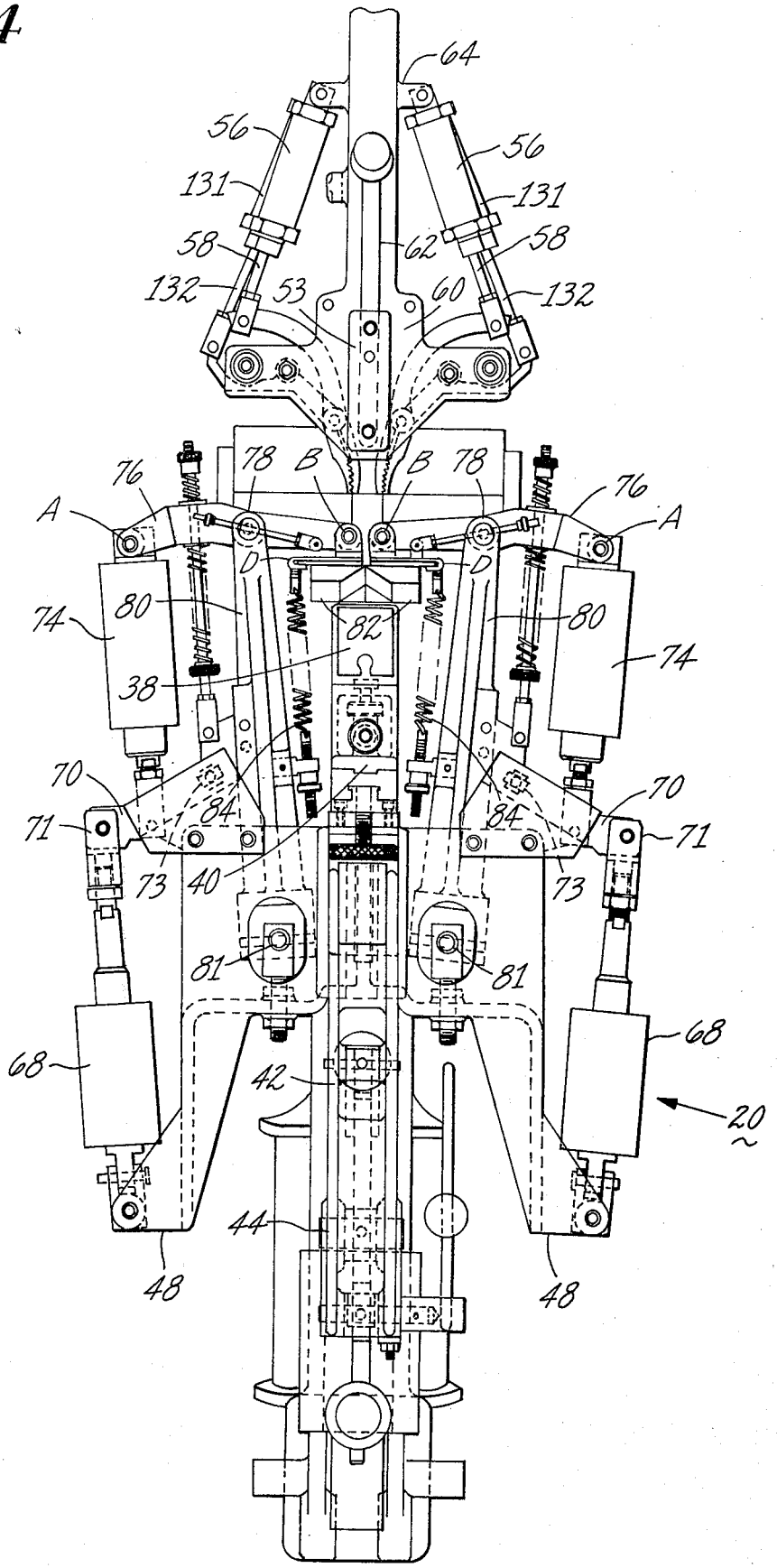
FIG. 4 is a front elevational view of one of the lasting instrumentalities of the present invention in its wipe mode.

FIGS. 2, 3 and 4 show a plurality of pivotally arranged cylinders which force an arrangement of wipers 82 into engagement with the shoe upper. A first cylinder arrangement 68 is pivotal at its lower end where it is connected to the frame portion 48 of the lasting instrumentality 20, as shown in FIG. 4. The upper end of a piston rod of the first cylinder 68 is pivotally connected to an end 71 of a lever 70 having an inner end 73 which is pivoted on the frame 48. The lower end of a piston rod of a second cylinder 74 is connected to an intermediate portion of the lever 70, the upper end of the cylinder 74 being pivotally attached to a lever arm 76 at an outermost point indicated by the letter A in FIG. 4. The lever arm 76 pivots about an axis 78 carried by a bifurcated upper portion of a support member 80 pivoted about its lower end with a universal joint 81 attached to the frame member 48.

Each lever arm 76 has a wiper pad or member 82 hingedly supported on its innermost end as indicated at B in FIG. 4. Each wiper member 82 is biased toward an angular disposition as seen in FIGS. 2, 3 and 4 by a spring 84 that is attached to its outermost edge at D. Each wiper 82, as shown more clearly in FIG. 12, has a certain curvilinear face 83 pre-contoured to conform generally to the respective edge of the shoe, or range of sizes of a particular style of shoe on which it is to operate. That is, opposite sides and bottom areas of a shoe have different contours so that the wipers at opposite sides also have different complementary contours. The wipers 82 may be made from a resilient block of material such as urethane and may typically have a size of 2.5 cm. ×5 cm. ×12.5 cm..

Figure 6:
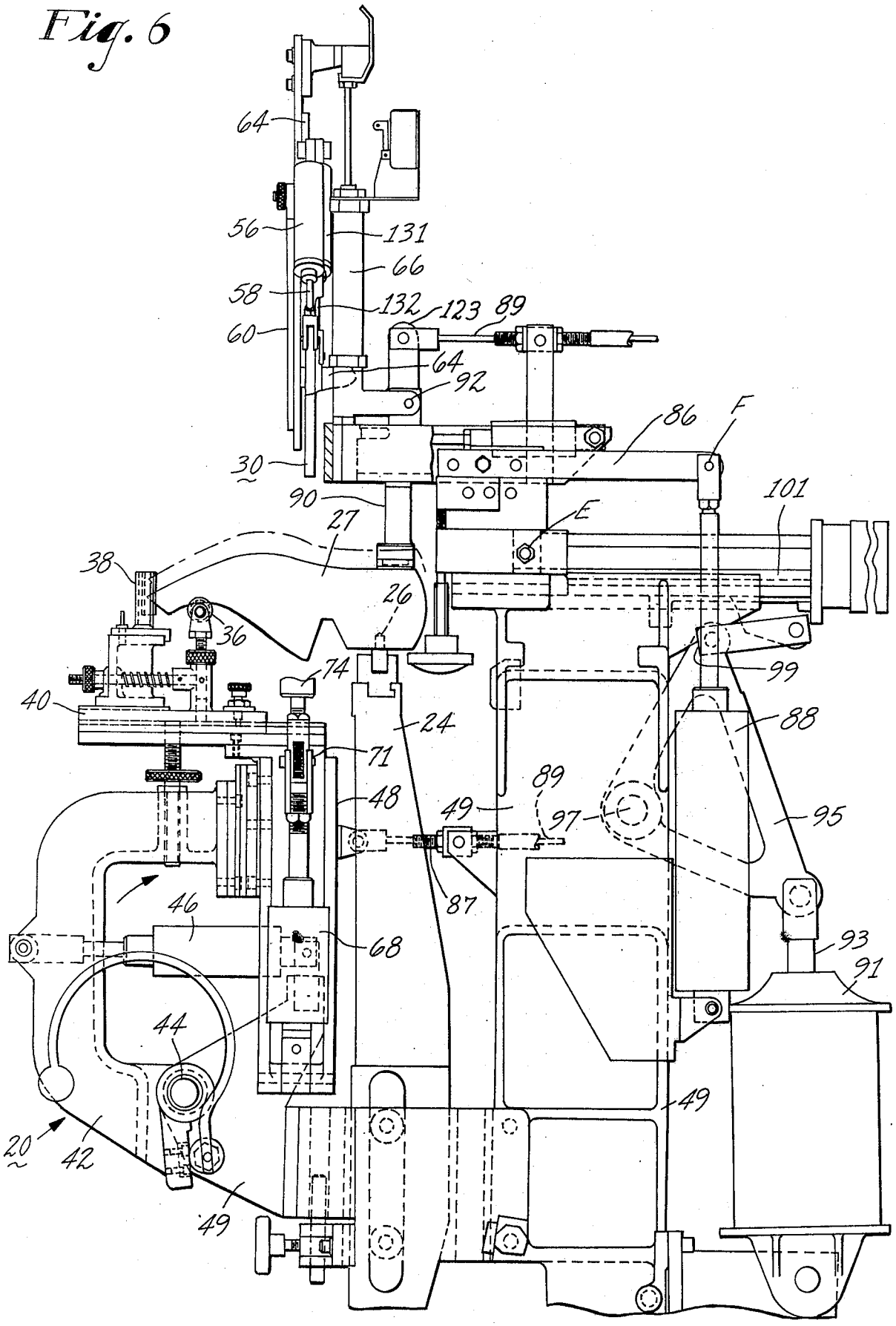
FIG. 6 is a view similar to FIG. 5 but with various parts in other positions assumed in a later part of the machine cycle.
Figure 7:
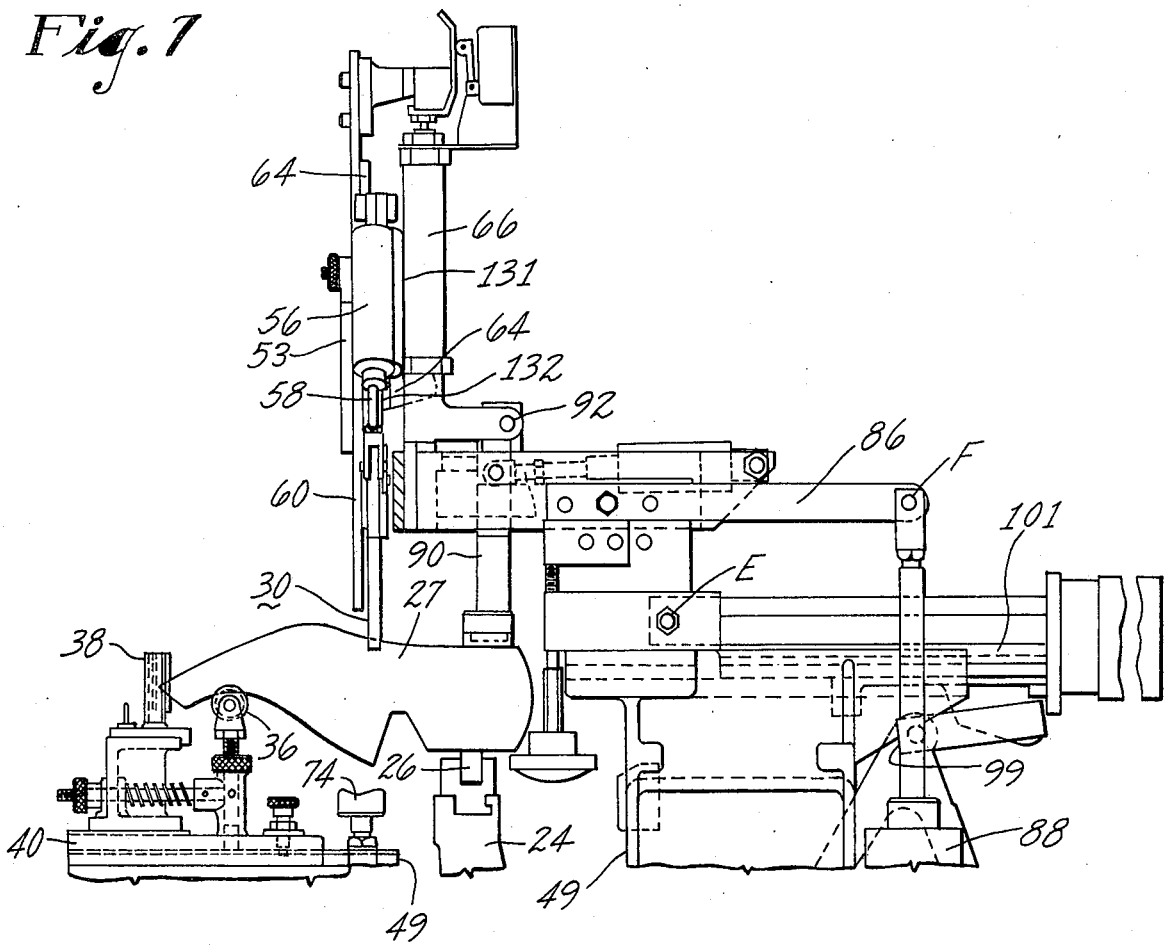
FIG. 7 is a side elevational view of a part of the mechanism shown in FIG. 5 and 6 but with certain parts shown in their tensioning mode.
Figure 8:
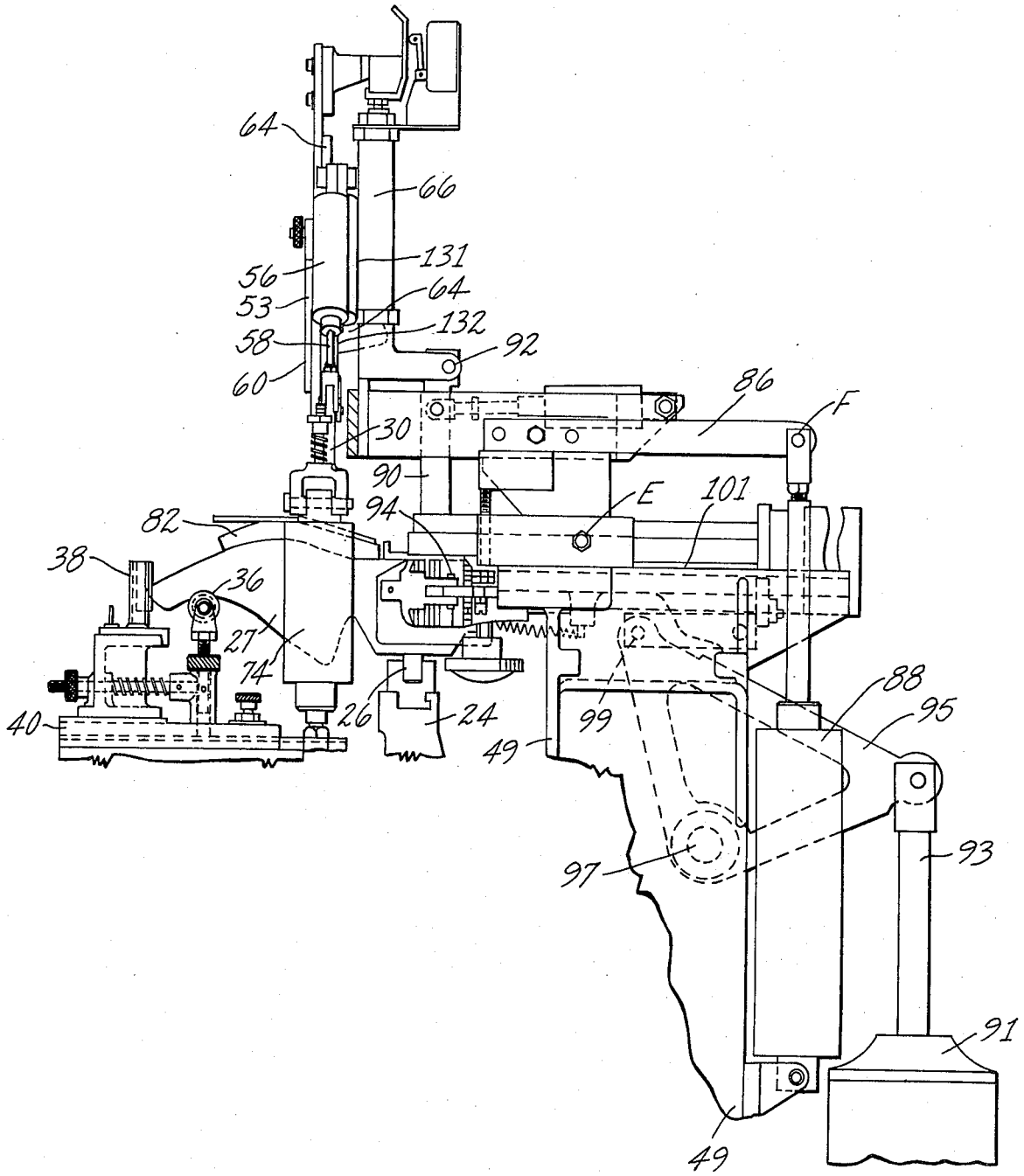
FIG. 8 is a view similar to FIG. 7 with parts shown in a grip-tensioning, side and heel wiping mode.

A shoe having a previously lasted toe portion is mounted on the jack post 24 at one of the lasting instrumentalities 20 or 22 depending upon whether the shoe is right or left. As shown in FIG. 5, the gripper supporting frame member 64 is in the inactive or a load location remote from the support to permit placement of the shoe thereon. The frame 64 is carried on a base unit 86 and may be swung about an axis E of a fixed part of the machine frame 49 by operation of a cylinder 88 from a position seen in FIG. 5 to that seen in FIG 6, after the initiation of the proper signal from which the forwardly disposed yoke 42 swings clockwise from the position shown in FIG. 5 about its lowermost axis 44 to the position shown in FIGS. 6 and 7 with the toe support 36 under the toe of the shoe and the toe pad 38 against the toe portion of the shoe. Shoe height gauge member 90 carried on a pin 92 in frame member 86, as shown in FIGS. 5 through 7, acts to properly seat the shoe last onto the jack post 24, establishing the proper wiping level and restraining it from undesirable heightwise movement when the unit 86 is in the position shown in FIG. 6. A push-pull cable 89, shown only in FIG. 6, may be mounted on frame 49 and attached between the movable frame member 48, which moves with yoke 42, and the frame 64, permitting sizing of the grippers 30 relative to any toe stop position. As the yoke 42 pivots forwardly or heelwardly about its axis 44 to adjust itself to a particular length shoe, the cable 89 is pushed into or pulled out of a cable support 87. The other end of the cable 89 is attached to an arm 123 which is part of frame 64. As the yoke 42 is pivoted forwardly, the cable 89 is pulled out from its lower support 87. This causes a pull heelwardly on arm 123 and makes it and the frame 64 pivot (clockwise, as shown in the drawings) about pin 92, causing the grippers 30 to swing forwardly in an arcuate path, adjusting their location for any length shoe in registration with the yoke 42.

The gripper members 30 precede the action of the side wiper pads in a sequence of operations shown in FIGS. 5, 6, 7 and 8. During the lasting operation, the grippers 30 grab the margin of the upper, pulling it tightly inwardly over the featherline of the insole, the side wiping operation of the side wiper pads 82 being initiated therewith, being shown in FIG. 8 but being omitted in FIGS. 6 and 7. The wiper pads 82 are swung arcuately inwardly toward the edge of the insole due to pressurization of the first cylinder arrangement 68 which causes the lever 70 therewith to swing upwardly, as can be seen in FIG. 4. This causes a movement in the second cylinder 74, which, through the lever 76, is connected to the side wiper pads 82. The first cylinder 68 causes the respective wipers to be moved inwardly above the insole of the shoe, causing a wiping force to be initiated, and the pressurization of the second cylinder 74 causes the respective wipers 82 to pivot around the horizontally disposed axis 78 in the lever arm 76, causing a bedding pressure to be initiated therewith.

A head 101 which carries a heel seat band 94, partially shown on the left side of FIGS. 10 and 11, and wiping arrangement 103, as partially shown on the right side of FIGS. 10 and 11, is slidable lengthwise of the shoe on an upper end of the frame base member 49. After the last is fully supported and located in the machine, the head 101 is moved to the left from the location seen in FIGS. 6 and 7 to that shown in FIG. 8. To this end a piston rod 93 of a cylinder 91, pivotally connected at its lower end on the base member 49, is connected to one arm of a bell crank lever 95 which swings on a pin 97 attached to the frame member 49. Extension of the piston rod swings the lever 95 counterclockwise by which connection at 99 slides the head 101 to the left.

The heel of the shoe is lasted by the heel seat wiper arrangement 103 which includes, as shown on the right side of FIGS. 10 and 11, an arrangement of biased wiper arms 98 telescoping from an arrangement of heel wiper plates 110, an arrangement of pivoted plates 112, a pair of links 114 connecting a unitary piston shaft 116 and crossbar 118 and a pressurizable cylinder arrangement 120. The pressurization of the cylinder 120 causes the extension of the piston rod 116 and cross bar 118 from the dotted position to the solid lines shown in FIG. 11. Such extension through the links 114 causes the upper plates 112 to wipe the heel end of the shoe via a cam follower arrangement between the plates 112 and plates 110. Both heel wiper plates 112 pivot about a common point M and then move lengthwise as shown in FIG. 11. The telescoping wiper arms 98 move with the upper plate and have a cam follower relationship with the heel wiper plates 110. Each telescoping wiper arm is biased extendedly by a spring 113. As each extended wiper arm 98 on each side of the shoe is brought inwardly toward the longitudinal center of the shoe by the cam follower relationship between the arm 98 and the heel wiper plate 10, the end of the arm 98 engages the heelward end of its adjacent floatingly mating side wiper member 82, and on continued toeward movement of the plate 110 the telescoping arms are forced inwardly to retract to the extent demanded by contact with the side wipers therewith. Thus the action of both telescoping wiper arms 98 in conjunction with heel wiper plates 110 and the self-locating side wiper pads 82 provides a continuum of wiping capability from one side of the ball zone of the shoe around the heel portion of the insole up to and including the other side of the ball zone.

Figure 12:
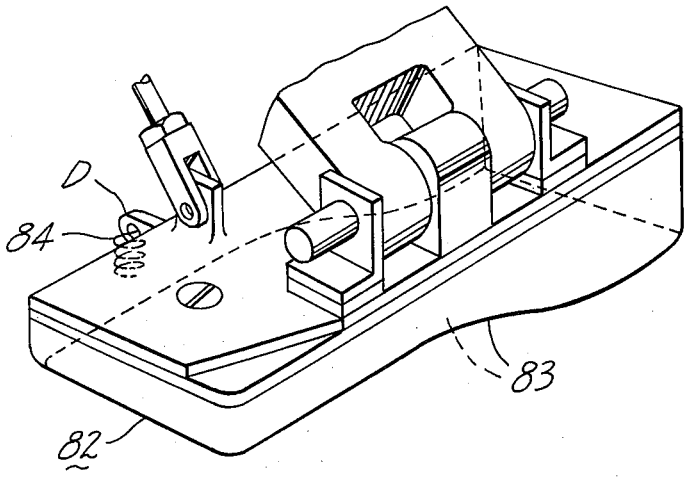
FIG. 12 is a perspective view of a particular wiper pad; and, FIG. 13 is a cross-sectional view of the wipper pads at opposite sides and in different positions with respect to the margins of an insole and an upper on the last.
Figure 13:
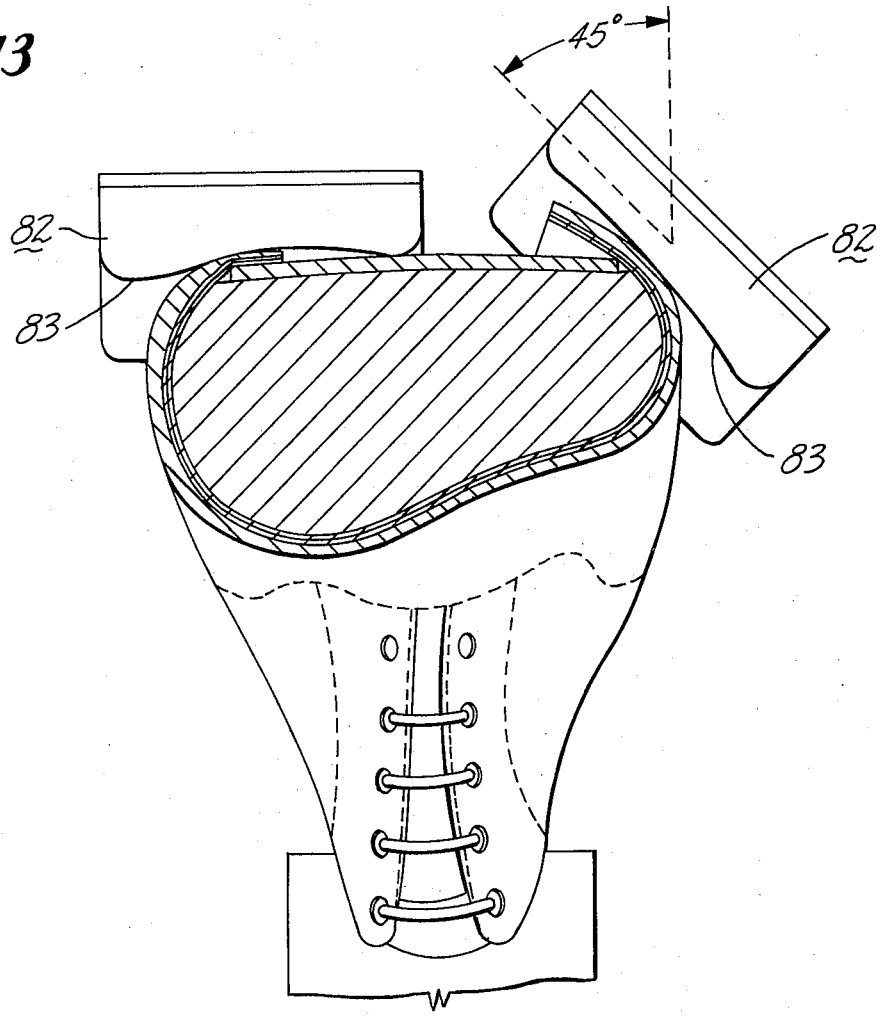

The close cooperation between the telescoping wiper arms 98 and the wiper pads 82 permits the desired continuity of wipe providing a quality lasting operation. The continuity is permitted because each wiper pad 82, as shown in FIG. 12, is contoured to movingly mate with and complement the average heightwise and widthwise curvatures of a range of sizes and styles of shoes on which it is to operate and because the telescoping wiper arms 98 adjust to the positioning of the wiper pads 82. The angular disposition of each wiper 82 as it engages its respective shoe side is shown at the right side of the FIG. 13 with the compound curvilinear bottom face 83 (that is, the curve lies more than one plane) of the wiper striking the featherline of the shoe at about 45°, as determined by the spring 84, as seen in FIGS. 2 and 4, the pad 82 pivoting about the featherline due to contact therewith, the pad 82 maintaining frictional engagement with the margin of the upper. The leading edge of the wiper pad 82 extends about one half cm. above the featherline as it moves inwardly and the face 83 thereof tends to locate a complementary curvature of the insole featherline. To this end, the wiper pad 82 is free to move lengthwise along the featherline from toe to heel, with a slight, inward force applied to the wiper so that the face 83 seeks to seat itself on the shank portion just rearward of the ball zone. This lenghtwise displacement of each wiper pad 82 is possible because each wiper pad 82 and its lever arm 76 is supported by the support member 80 which has a universal joint at its base. As each wiper pad 82 finds and locks against the featherline, the tensioned upper is forced downward onto the insole and last, the grippers 30 therewith releasing their grip on the margin of the upper. The margin of the upper is forced downward onto the insole and last by the portion of the wiper that extends above and over the insole featherline, as shown in FIG. 13. The heavy force applied to the wiper pads 82 causes the shoe to be lasted by axial movement of the wiper pads 82 which is also biased by the spring 84, followed by the bedding force caused by pressurization of the cylinders 74.

Although the invention has been described with a certain degree of particularity, the appended claims are intended as exemplary only and not in a limiting sense.

what I desire to claim by United States Letters Patent is:

1. A machine for lasting at least one side of a shoe, said machine comprising:

a support for locating and holding a last with an upper assembled thereon;

an arrangement of at least one gripper for tensioning the side margin of the upper heightwise of the bottom of said shoe;

a wiper member for lasting at least one side of said shoe including a resilient member having a compound curvature on its face contoured to conform to the edge and bottom of the side of said shoe on which it is to operate; and means for bodily moving said wiper member inwardly at an angular disposition and widthwise of said shoe to press said tensioned upper first against the feather edge of the side of said shoe and thereafter to wrap the upper margin against the bottom of said shoe by a pivoting movement of said wiper member;

said wiper member locating the complementary shape of said shoe by first floatingly engaging the featherline near the ball zone of the shoe bottom, whereupon the bias in said wiper member forces the complementarily contoured surfaces to register causing the upper and insole to adhere with one another.

2. A machine for lasting at least one side of a shoe as recited in claim 1, wherein said gripper arrangement releases the tensioned side margin of said upper as said wiper clamps said margin over the edge of the insole.

3. A machine for lasting at least one side of a shoe as recited in claim 1, wherein said machine includes:

a heel seat wiper means comprising at least one movably supported arm that is caused to move against the heel of the bottom of said shoe to wipe the margin of the upper against the heel, said heel seat wiper arm having an end that is telescopingly extendible and biased in the extended direction by a spring therewithin, said heel seat wiper arm extending to the heelward edge of said side wiper member, thereby providing a continuity of wiping to the margin of the upper from the heel to the ball zone of said shoe.

4. A machine for lasting at least one side of a shoe as recited in claim 1, wherein said support for said last comprises a jack pin capable of movement generally vertically and horizontally;

said grippers comprising a pair of pincers which are movingly mounted on a yoke that pivotally approaches said supported shoe.

5. A machine for lasting at least one side of a shoe as recited in claim 1, wherein said pivoting movement of said wiper member is due to the contact between said wiper member and said featherline, causing a turning thereon while maintaining frictional engagement with the margin of the upper.

6. A machine for lasting at least one side of a shoe as recited in claim 1, wherein said means for bodily moving said wiper member widthwise of said shoe comprises a hingedly supported arm having said wiper member movably connected at one end, and a first pressurizable cylinder arrangement at the other end.

7. A machine for lasting at least one side of a shoe as recited in claim 1, wherein said means for bodily moving said wiper member inwardly of said shoe also comprises a second pressurizable cylinder arrangement, one end of which is connected movably to the frame of said machine, the other end being movably connected to a seccond arm connected also to the frame of said machine, said second arm being movably connected to the remaining end of said first pressurizable cylinder arrangement.

8. A machine for lasting at least one side of a shoe as recited in claim 1, wherein said angular disposition of said wiper is maintained by a spring connected between said wiper member and the frame of said machine.

9. A machine for providing a continuity of lasting to the margin of a shoe upper from the ball zone to around the heel comprising:

a pre-contoured resilient wiper member for lasting a side portion of a particular range of sizes of a shoe, and a heel wiper comprising a pivoting heel wiper plate and including a yieldably extendable wiper arm registered therewith, said wiper arm biased outwardly and telescopingly extending to the heelward edge of said side wiper member.

10. A machine for providing a continuity of lasting to the margin of a shoe upper as recited in claim 9, including:

a pair of gripper members for gripping and tensioning said shoe upper over the insole of the shoe bottom;

said gripper members being pivotally mounted on a movable frame member; and said movable frame member being pivotally movable toward and away from the shoe bottom.

11. A machine for providing a continuity of lasting to the margin of a shoe upper as recited in claim 11 wherein each of said gripper members comprises:

a pair of curvilinear jaw members;

said jaw members being pivotally connected to one another;

one of said jaw members being pivotally connected to said movable frame member; and each of said jaw members being connected at their upper ends to a piston and cylinder arrangememt.

12. A machine for providing a continuity of lasting to the margin of a shoe upper as recited in claim 11 wherein one of each of said pairs to jaw members is in registration with a rotatable cam; and said cam being mounted on said movable frame member, a rotation of said cam providing width adjustment capabilities to the respective gripper members.

13. A machine for providing a continuity of lasting to the margin of a shoe upper as recited in claim 12, wherein said machine includes:

a toe support arrangement mounted on a toewardly and heelwardly pivotable yoke member; and a push-pull cable attached between said toewardly and heelwardly pivotable yoke and said movable frame member supporting said grippers, movement of said yoke causing a corresponding movement of said cable, permitting sizing of said grippers relative to the size of a shoe supported on said toe support arrangement.

* * * * *

PO-1050
(5/69)

UNITED STATES PATENT OFFICE
CERTIFICATE OF CORRECTION

Patent No. 3,995,340 Dated December 7, 1976

Inventor(s) Karl V. Becker

It is certified that error appears in the above-identified patent and that said Letters Patent are hereby corrected as shown below:

Column 8, Cl. 11, Line 36, after the word claim change the numeral 11 to 10--

Signed and Sealed this

Twenty-second Day of February 1977

[SEAL]

*Attest:*

RUTH C. MASON
*Attesting Officer*

C. MARSHALL DANN
*Commissioner of Patents and Trademarks*